US012193618B2

(12) United States Patent
Ma et al.

(10) Patent No.: US 12,193,618 B2
(45) Date of Patent: Jan. 14, 2025

(54) TOILET ARMREST

(71) Applicant: Xiamen Sunten Sanitary Ware Industry Co., Ltd., Fujian (CN)

(72) Inventors: Haibin Ma, Fujian (CN); Dongzhen Zhang, Fujian (CN)

(73) Assignee: Xiamen Sunten Sanitary Ware Industry Co., Ltd., Fujian (CN)

( * ) Notice: Subject to any disclaimer, the term of this patent is extended or adjusted under 35 U.S.C. 154(b) by 0 days.

(21) Appl. No.: 18/476,813

(22) Filed: Sep. 28, 2023

(65) Prior Publication Data

US 2024/0172902 A1 May 30, 2024

(30) Foreign Application Priority Data

Nov. 28, 2022 (CN) ..... 202223164765.8

(51) Int. Cl.
*A47K 17/02* (2006.01)

(52) U.S. Cl.
CPC ..... *A47K 17/026* (2013.01); *A47K 17/02* (2013.01)

(58) Field of Classification Search
CPC ..... A47K 17/026; A47K 17/02; A47K 17/00
USPC ..... 248/118
See application file for complete search history.

(56) References Cited

U.S. PATENT DOCUMENTS 3,405,411 A * 10/1968 Brown ..... A47K 17/02 4/254
3,474,471 A * 10/1969 Matibag ..... A47K 17/026 297/411.32
3,969,778 A * 7/1976 Richards ..... A47K 17/026 4/254
4,196,480 A * 4/1980 Guenther ..... A47K 17/026 4/300
4,715,069 A * 12/1987 James ..... A47K 17/026 4/254
D336,682 S * 6/1993 Francke ..... D23/309
5,526,537 A * 6/1996 Conrad ..... A47K 11/04 297/188.12
5,832,542 A * 11/1998 Dominguez ..... A47K 17/026 4/254
6,418,567 B1 * 7/2002 Brinkman ..... A47K 17/026 297/411.3
6,449,783 B1 * 9/2002 Moser ..... A61G 7/1094 4/667
8,800,074 B2 * 8/2014 Rodgers ..... E03D 11/12 4/667
10,835,433 B2 * 11/2020 Schwab ..... A61G 7/1007
2005/0166306 A1 * 8/2005 Crisostomo ..... A47K 17/026 4/254

(Continued)

*Primary Examiner* — Nkeisha Smith
(74) *Attorney, Agent, or Firm* — Cooper Legal Group, LLC

(57) ABSTRACT

A toilet armrest, including a fixed seat and an armrest body; a first limit part is formed on the armrest body, the fixed seat is formed with a second limit part to limit the armrest body continues to swing at a lower limit position; a first clamp part is formed on the armrest body, a second clamp part is formed on the fixed seat; at least one of the first clamp part and the second clamp part is capable of being elastically deformed, so that the first clamp part passes through the second clamp part to provide resistance when the armrest body is swung into or out of the lower limit position. It enables the armrest to be securely swung to the side of the toilet seat for use by those with limited mobility, or to be swung to a position that avoids the toilet seat.

9 Claims, 6 Drawing Sheets

(56) References Cited

U.S. PATENT DOCUMENTS

2019/0186115 A1* 6/2019 Schwab ..... A47K 10/48

* cited by examiner

TOILET ARMREST

CROSS-REFERENCE TO RELATED APPLICATIONS

This application claims the priority benefit of China application No. 202223164765.8, filed on Nov. 28, 2022. The entirety of China application No. 202223164765.8 is hereby incorporated by reference herein and made a part of this specification.

TECHNICAL FIELD

The present disclosure relates to the field of toilet technology, in particular to a toilet armrest.

BACKGROUND

In current, toilets are usually not equipped with armrests. For the elderly, disabled or pregnant women who have difficulty squatting up, it is difficult to stand up again after sitting on the toilet. Therefore, considering the use of this group of people, some of the current washroom are provided with fixed armrests installed on the wall near the side of the toilet, which makes it easier for these people to stand up with the help of armrests. However, the installation of armrests has a significant impact on the renovation of the washroom, and most toilets in the washroom are usually not against the wall or only have one side against the wall, which does not meet the conditions for installing armrests. Moreover, there is also the problem of taking up space in the washroom when armrests are installed. If the armrest is directly fixed on the toilet, although it can solve the above problems, for users who do not need the armrest, the setting of the armrest actually hinders the process of squatting on the toilet.

If an armrest installed on the toilet is capable to rotate, the armrest can be firmly rotated to the side of the toilet seat for use by people with limited mobility, for people with convenient mobility, it can be rotated to avoid the upper part of the toilet seat, so as to avoid obstacles to its use, which will make the toilet armrest more versatile.

SUMMARY

The objective of this present disclosure is to provide a toilet armrest, which overcomes the above defects and enables the armrest to be swung on the toilet at any time to avoid the toilet seat, or securely swung to the side of the toilet seat for use by people with limited mobility.

To achieve the above objective, the solution of the present disclosure is: A toilet armrest, including a fixed seat and an armrest body, wherein the fixed seat is configured to fix with a toilet;

the armrest body is horizontally pivot connected to the fixed seat;

a first limit part is formed on the armrest body, the fixed seat is formed with a second limit part, and the second limit part is located on a motion path of the first limit part following a lower swing of the armrest body and is configured to contact the first limit part, so as to limit the armrest body continues to swing at a lower limit position;

a first clamp part is formed on the armrest body, a second clamp part is formed on the fixed seat, and the second clamp part protrudes to a motion path where the first clamp part on the armrest body swings with the armrest body; at least one of the first clamp part and the second clamp part is capable of being elastically deformed, and the first clamp part passes through the second clamp part to provide resistance when the armrest body is swung into or out of the lower limit position.

Further, a limit rod is horizontally fixed on the fixed seat, an U-shaped limit groove is formed on the armrest body at a corresponding position to the limit rod, and the U-shaped limit groove is provided with an opening downward to provide for the limit rod to slide in when the armrest body is swung down;

the first limit part is a bottom of the U-shaped limit groove, and the second limit part is a top side rod wall of the limit rod;

a side wall of the U-shaped limit groove protrudes to form the first clamp part, and the second clamp part is a rod wall of one side of the limit rod facing the first clamp part inside the U-shaped limit groove.

Further, the first clamp part is located on one side of the U-shaped limit groove away from a pivot rotation axis of the armrest body and the fixed seat.

Further, a bottom of the armrest body is horizontally hinged on the fixed seat, and the U-shaped limit groove is opened at a bottom end of the armrest body.

Further, the first limit part and the second limit part are flat surfaces fitting with each other.

Further, the toilet armrest further includes a fixed plate, the fixed plate is used to fix on the toilet, there are two of the fixed seats at a left end and a right end on the fixed plate, and each fixed seat is pivotally connected to the armrest body.

Further, the fixed plate is longitudinally penetrated to form a mounting hole.

Further, the fixed plate is provided with an anti-slip pad at fitting area with the toilet.

Further, the armrest body is in L-shape with smooth transition surface.

After adopting the above solution, the advantageous effects of this present disclosure are shown as below:

(1) The fixed seat is fixed on the toilet, and the armrest body is horizontally pivot connected to the fixed seat. The second limit part on the fixed seat is set on the downward swinging motion path of the first limit part on the armrest body, to limit the armrest body continues to swing down at the lower limit position, such that the armrest body moves above the side of the toilet seat after swinging down, and can provide upward support for those with limited mobility to assist; or avoid the top of the toilet seat after swinging up, so as to avoid obstacles for people with convenient mobility;

(2) The second clamp part on the fixed seat protrudes onto the motion path where the first clamp part on the armrest body swings with the armrest body, which is used to clamp with the first clamp part when the armrest body swings in or out of the lower limit position. At least one of the first clamp part and the second clamp part can deform elastically, and only when the user acts on the armrest body to generate sufficient torque can overcome the elastic force to make the first clamp part pass through the second clamp part. So that resistance is provided when the armrest body is swung up from the lower limit position to avoid the upper part of the toilet seat, preventing the armrest body from shaking and becoming unstable when moved to the lower limit position for use.

Label description: 1—Fixed seat, 2—Armrest body, 3—First limit part, 4—Second limit part, 5—First clamp part, 6—Second clamp part, 7—Limit rod, 8—U-shaped limit groove, 9—Fixed plate, 10—Mounting hole, 11—Anti-slip pad, 12—Bottom plate, 13—Side plate, 14—Shaft rod, 15—Shaft hole, 16—Connecting portion, 17—Grasping portion, 18—Sealing cover, 19—Sealing cover opening.

DETAILED DESCRIPTION OF THE EMBODIMENTS

The following provides a detailed illustration of the present disclosure in conjunction with the accompanying drawings and specific embodiments.

Figure 1:
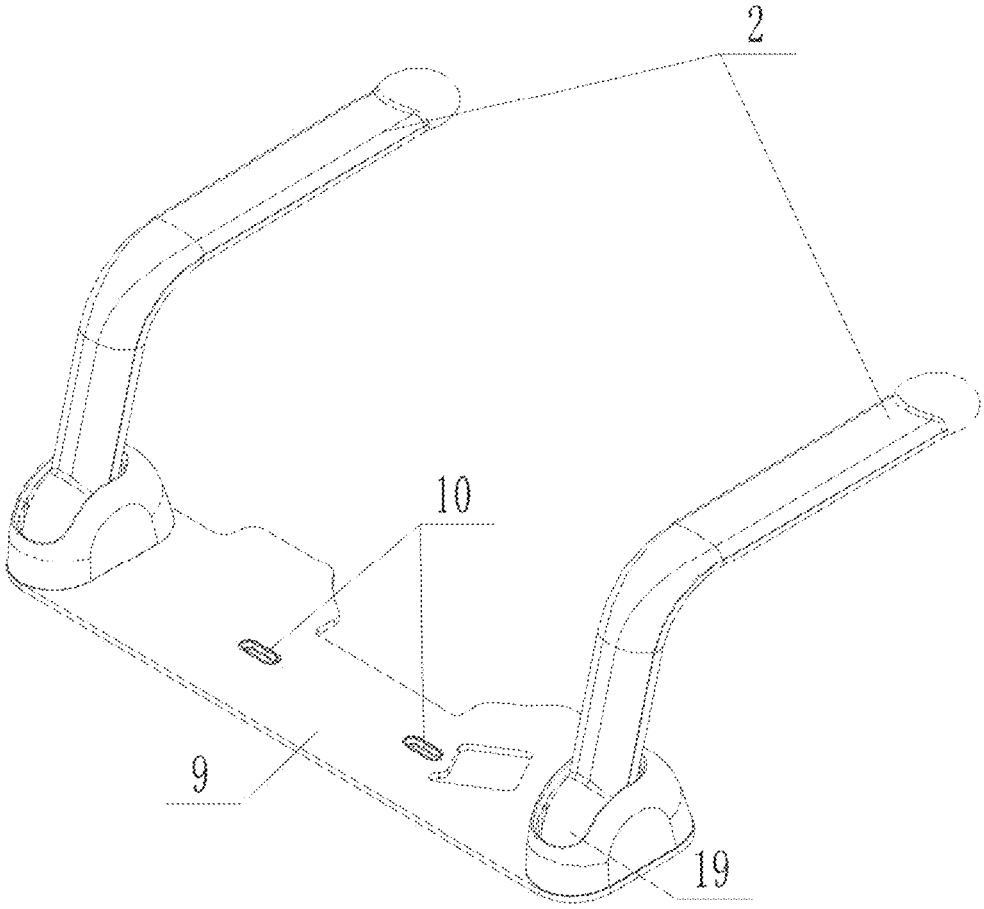
FIG. 1 is a schematic diagram of the three-dimensional structure of the armrest body of the present disclosure that extends forward after being swung downward.
Figure 2:
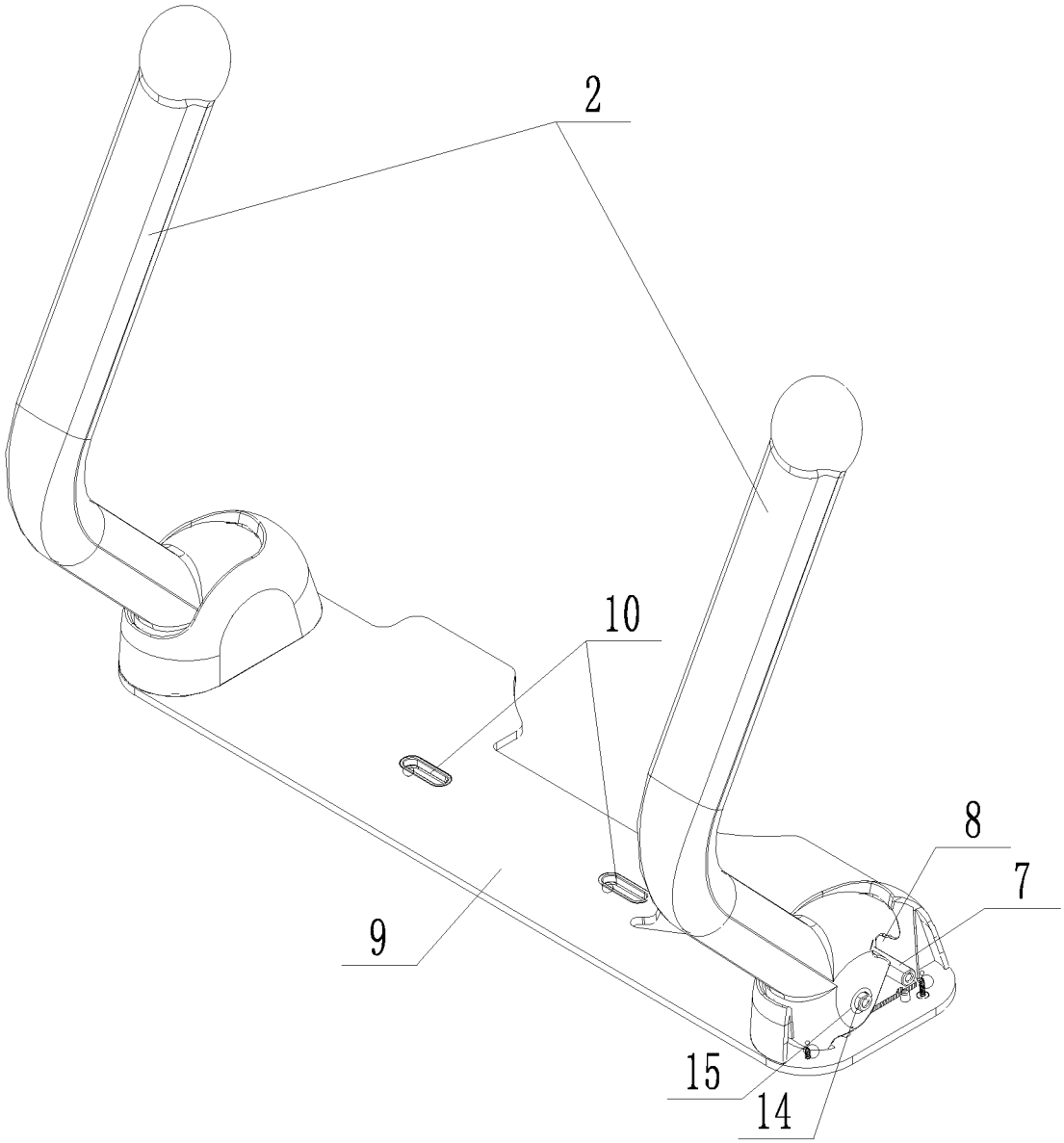
FIG. 2 is a schematic diagram of the partial cross-sectional structure of the armrest body of the present disclosure that is folded back after being swung upward.
Figure 3:
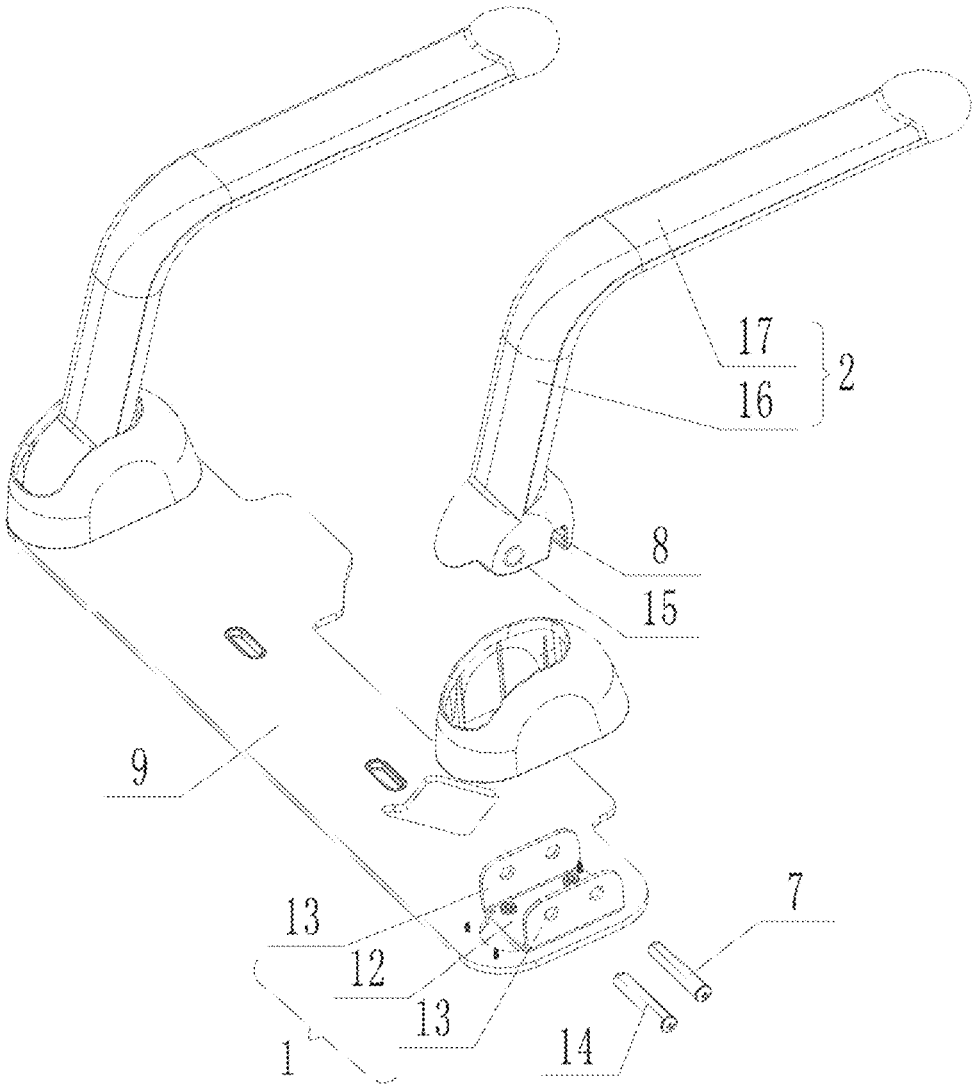
FIG. 3 is a partial exploded structure of this present disclosure.
Figure 4:
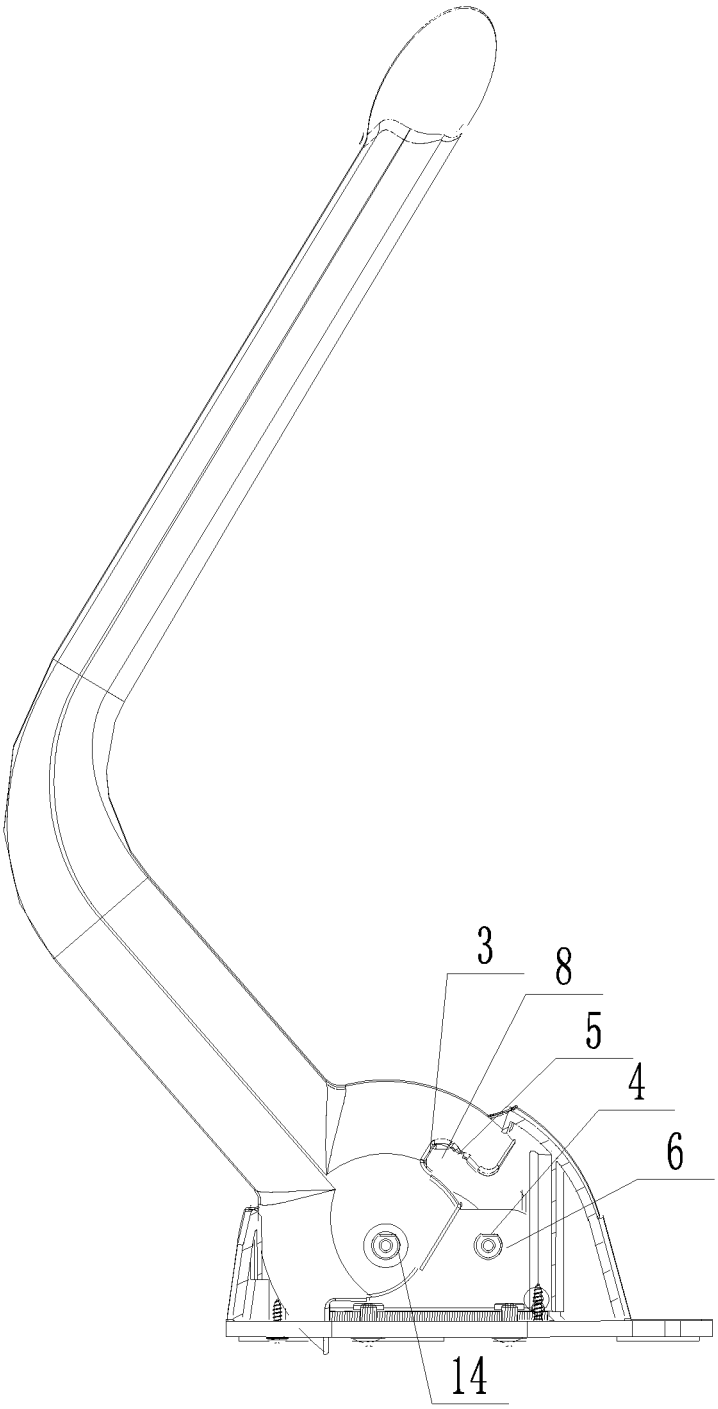
FIG. 4 is a schematic diagram of the cross-sectional structure of the side view portion of the armrest body of the present disclosure that is folded back after being swung upward.
Figure 5:
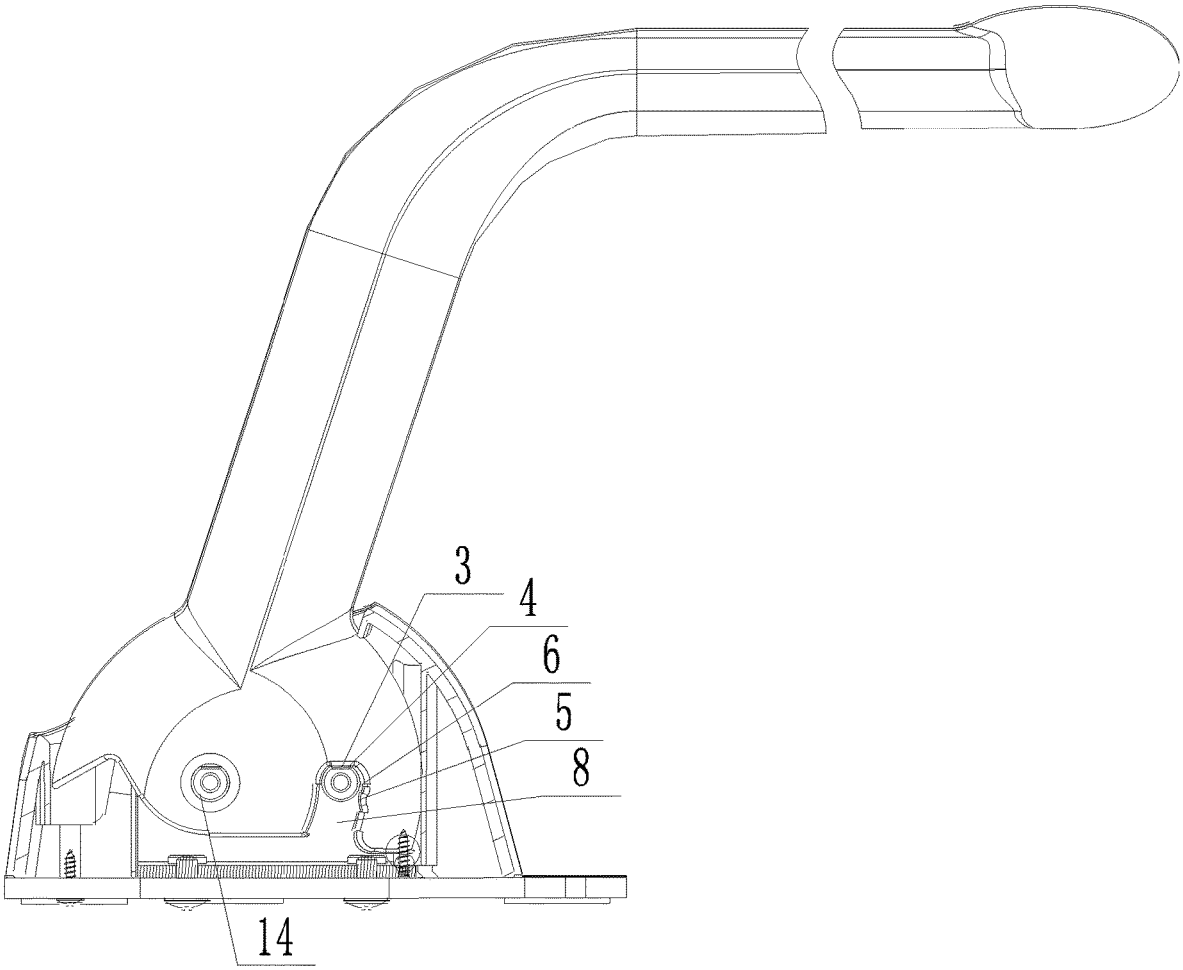
FIG. 5 is a schematic diagram of the cross-sectional structure of the side view portion of the armrest body of the present disclosure that extends forward after being swung downward.
Figure 6:
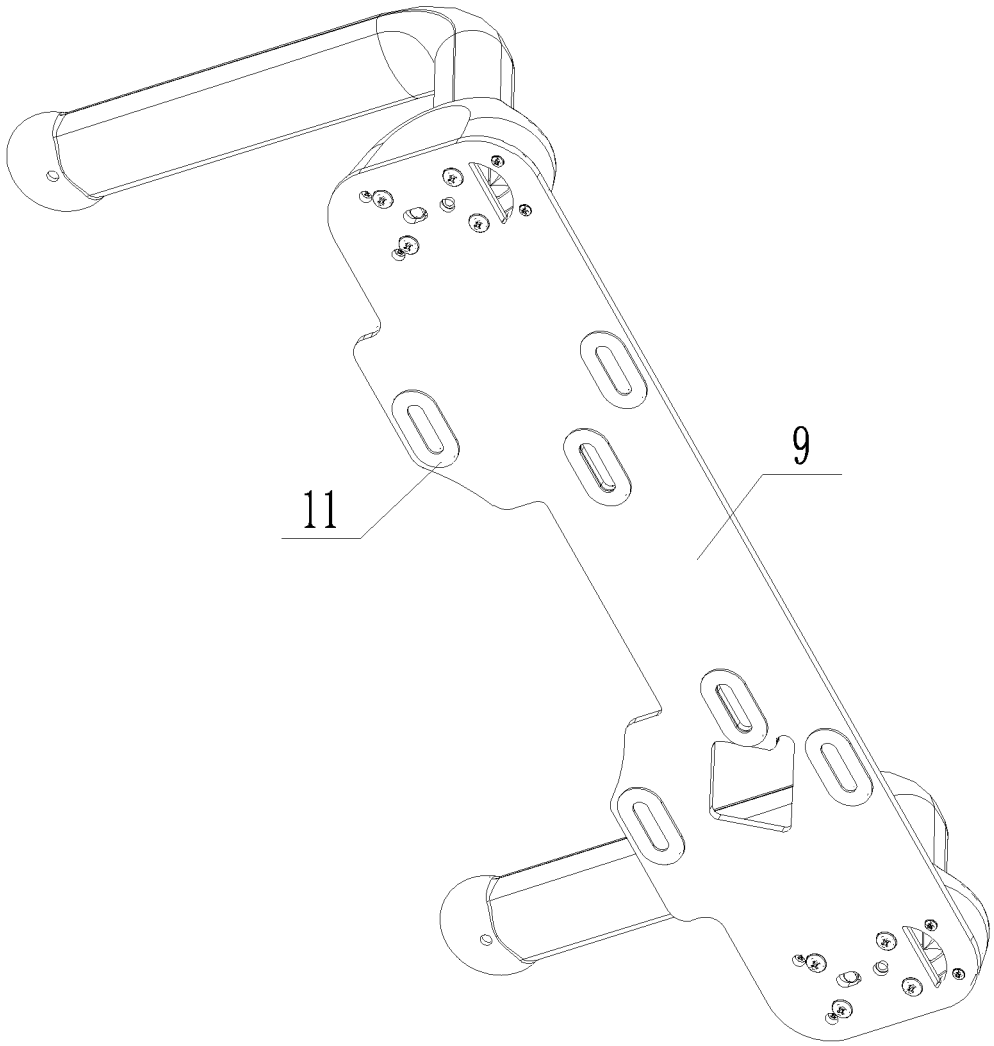
FIG. 6 is a schematic diagram of the bottom structure of the fixed plate of this present disclosure.

The present disclosure provides a toilet armrest, as shown in FIGS. 1-6, which includes a fixed seat 1 and a armrest body 2. The fixed seat 1 is configured to fix with the toilet, and the fixed manner is not limited. The armrest body 2 is horizontally pivot connected to the fixed seat 1, and the specific shape of the armrest body 2 is not limited, as long as it can extend forward to the side of the user sitting on the toilet after swinging downward, avoid the direct above of the toilet after swinging upward, and fold back to the back of the toilet. A first limit part 3 is formed on the armrest body 2, a second limit part 4 is formed on the fixed seat 1, and the second limit part 4 is located on the motion path of the first limit part 3 following the downward swing of the armrest body 2, which is used to contact the first limit part 3, so as to limit the armrest body 2 continues to swing downward at the lower limit position. The shape and structure of the first limit part 3 and the second limit part 4 are not limited. As long as they are set at the corresponding positions mentioned above with sufficient strength to withstand a certain amount of squeezing force when they contact with each other. Such that when the armrest body 2 is swung to the lower limit position, the user presses down on the armrest body 2, which can provide sufficient support for the user and make it easier for the user to stand up. A first clamp part 5 is formed on the armrest body 2, a second clamp part 6 is formed on the fixed seat 1, and the second clamp part 6 protrudes to the motion path where the first clamp part 5 swings with the armrest body 2. At least one of the first clamp part 5 and the second clamp part 6 can deform elastically. The first clamp part 5 and the second clamp part 6 may be structures that can deform elastically or made of elastic materials, and the first clamp part 5 passes through the second clamp part 6 to provide resistance when the armrest body 2 swings in or out of the lower limit position. Therefore, only when the user applies sufficient lifting force to the armrest body 2 to make the swing of the armrest body 2 have sufficient torque, can the first clamp part 5 and/or the second clamp part 6 generate elastic deformation to allow the first clamp part 5 to pass through the second clamp part 6, making it possible for the armrest body 2 to continue to swing. When the first clamp part 5 passes through the second clamp part 6, it provides resistance when the armrest body 2 is swung out of the lower limit position, preventing the armrest body 2 from shaking along the folding direction and not being firmly fixed during use.

Specifically, in this embodiment, it further includes a fixed plate 9 used to fix on the toilet. There are two fixed seats 1 provided on the upper surface of the fixed plate 9 at the left and right sides, and each fixed seat 1 is pivotally connected to one armrest body 2. After being lowered to the lower limit position, the two armrest bodies 2 are respectively located on the left and right sides of the toilet. Preferably, in order to facilitate the fixation of the fixed plate 9 on the toilet, the fixed plate 9 is longitudinally penetrated to form a mounting hole 10, so that the support seat (conventional arrangement of existing toilets, not shown in the attached figure) for fixing the toilet seat and the toilet cover above the toilet pool passes through the mounting hole 10, and then the toilet seat and the toilet cover are installed and fixed on the support seat, in this way, the fixed plate 9 is clamped and fixed between the toilet pool, the toilet seat, and the toilet cover to complete the fixation of the fixed plate 9. The installation process is very convenient and has high universality. To enhance the fixation effect, the fixed plate 9 is equipped with an anti-slip pad 11 at the fitting area with the toilet. In this embodiment, the anti-slip pad is specifically set on the bottom surface of the fixed plate 9 to increase the friction force between the fixed plate 9 and the toilet pool.

In this embodiment, the fixed seat 1 is a U-shaped plate component, including a bottom plate 12. There is a side plate 13 connected to each side of the bottom plate 12, and a shaft rod 14 and a limit rod 7 extend horizontally between the two side plates 13. The limit rod 7 is arranged in front of the shaft rod 14 at a certain distance, and the armrest body 2, which is composed of the connecting portion 16 and the grasping portion 17, is in an L-shape with smooth transition surface. The top of the connecting portion 16 of the armrest body 2 is connected to the grasping portion 17. At the bottom, there is a shaft hole 15 that runs through the left and right sides, and the shaft hole 15 is rotated and sleeved on the outer wall of the shaft rod 14 to achieve the pivot connection between the armrest body 2 and the fixed seat 1. An U-shaped limit groove 8 is formed at the bottom end of the connecting portion 16 of the armrest body 2 corresponding to the position of the limit rod 7. The U-shaped limit groove 8 extends left and right and is provided with the opening downward, to provide for the limit rod 7 to slide in when swinging down with the armrest body 2. The first limit part 3 is the bottom of the U-shaped limit groove 8, and the second limit part 4 is the top side rod wall of the limit rod 7. The side wall of the U-shaped limit groove 8 protrudes to form the first clamp part 5. The second clamp part 6 is the rod wall of one side of the limit rod 7 facing the first clamp part 5 in the U-shaped limit groove 8. The armrest body 2 has elasticity at the U-shaped limit groove 8, allowing the first clamp part 5 to deform and give way to the second clamp part 6.

In a preferred embodiment, in order to avoid deformation of the shaft hole 15 caused by the second clamp part 6 when squeezing the first clamp part 5, which affects the pivot rotation of the armrest body 2, the first clamp part 5 is located on the side of the U-shaped limit groove 8 away from the pivot rotation axis of the armrest body 2 and the fixed seat 1.

In a preferred embodiment, in order to prevent radial force generated by the armrest body 2 relative to the pivot rotation axis when the first limit part 3 and the second limit part 4 contact with each other, affecting the pivot rotation of the armrest body 2, and ensuring that the first limit part 3 and the second limit part 4 can generate sufficient support when they contact with each other, the diameter of the limit rod 7 is smaller than the width of the U-shaped limit groove 8, and the first limit part 3 and the second limit part 4 are flat surfaces fitting with each other.

In a preferred embodiment, sealing covers 19 are installed on the fixed plate 9 at the corresponding position to each fixed seat 1 respectively. The sealing cover 19 is covered outside the fixed seat 1, and the top of the sealing cover 19 has a sealing cover opening for extending the armrest body.

The above is only a preferred embodiment of this present disclosure and is not a limitation. Any equivalent changes made based on the design key of this present disclosure fall within the scope of the present disclosure.

What is claimed is:

1. A toilet armrest, comprising a fixed seat and an armrest body, wherein:

the fixed seat is configured to fix with a toilet;

the armrest body is horizontally pivot connected to the fixed seat;

a first limit part is formed on the armrest body;

the fixed seat is formed with a second limit part;

the second limit part is located on a motion path of the first limit part following a lower swing of the armrest body and is configured to contact the first limit part, so as to limit the armrest body from continuing to swing beyond a lower limit position;

a first clamp part is formed on the armrest body;

a second clamp part is formed on the fixed seat;

the second clamp part protrudes to a motion path where the first clamp part on the armrest body swings with the armrest body;

at least one of the first clamp part or the second clamp part is configured to be elastically deformed; and the first clamp part passes through the second clamp part to provide resistance when the armrest body is swung into or out of the lower limit position.

2. The toilet armrest according to claim 1, wherein:

a limit rod is horizontally fixed on the fixed seat;

a U-shaped limit groove is formed on the armrest body at a position corresponding to the limit rod;

the U-shaped limit groove is provided with an opening downward to provide for the limit rod to slide in when the armrest body is swung down;

the first limit part is a bottom of the U-shaped limit groove;

the second limit part is a top side rod wall of the limit rod;

a side wall of the U-shaped limit groove protrudes to form the first clamp part; and the second clamp part is a rod wall of one side of the limit rod facing the first clamp part inside the U-shaped limit groove.

3. The toilet armrest according to claim 2, wherein the first clamp part is located on one side of the U-shaped limit groove away from a pivot rotation axis of the armrest body and the fixed seat.

4. The toilet armrest according to claim 2, wherein:

a bottom of the armrest body is horizontally hinged on the fixed seat; and the U-shaped limit groove is opened at a bottom end of the armrest body.

5. The toilet armrest according to claim 1, wherein the first limit part and the second limit part are flat surfaces fitting with each other.

6. The toilet armrest according to claim 1, wherein:

the toilet armrest further comprises a fixed plate;

the fixed plate is used to fix on the toilet, there are two of the fixed seats at a left end and a right end on the fixed plate; and each fixed seat of the two of the fixed seats is pivotally connected to the armrest body.

7. The toilet armrest according to claim 6, wherein the fixed plate is longitudinally penetrated to form a mounting hole.

8. The toilet armrest according to claim 6, wherein the fixed plate is provided with an anti-slip pad at a fitting area with the toilet.

9. The toilet armrest according to claim 1, wherein the armrest body has an L-shape with a transition surface.

* * * * *